US006641282B2

(12) United States Patent
Perlo et al.

(10) Patent No.: US 6,641,282 B2
(45) Date of Patent: Nov. 4, 2003

(54) CONTROLLED-LUMINANCE LIGHTING DEVICE

(75) Inventors: Piero Perlo, Sommariva Bosco (Cuneo) (IT); Denis Bollea, Fiano (Turin) (IT); Davide Capello, Turin (IT); Piermario Repetto, Turin (IT)

(73) Assignee: C.R.F. Societa Consortile Per Azioni, Orbassano (IT)

( * ) Notice: Subject to any disclaimer, the term of this patent is extended or adjusted under 35 U.S.C. 154(b) by 0 days.

(21) Appl. No.: 10/145,885

(22) Filed: May 16, 2002

(65) Prior Publication Data

US 2002/0172046 A1 Nov. 21, 2002

(30) Foreign Application Priority Data

May 18, 2001 (IT) ..... TO2001A0464

(51) Int. Cl.[7] ..... F21V 7/06
(52) U.S. Cl. ..... 362/217; 362/346; 362/297
(58) Field of Search ..... 362/217, 304, 362/346, 297, 260, 350

(56) References Cited

FOREIGN PATENT DOCUMENTS

| | | | |
|---|---|---|---|
| DE | 3704501 A1 | * | 9/1987 |
| FR | 2476799 A | * | 8/1981 |
| WO | WO 97/45674 | * | 12/1997 |

* cited by examiner

*Primary Examiner*—Sandra O'Shea
*Assistant Examiner*—Hargobind S. Sawhney
(74) *Attorney, Agent, or Firm*—Sughrue Mion, PLLC

(57) ABSTRACT

A controlled-luminance lighting device comprising a fluorescent lamp (1), which extends longitudinally between a primary reflector (2) and a secondary reflector (3). The primary reflector (2) is formed by a plurality of cup-like elements (4) set alongside one another, having a generally parabolic shape, through which there extends the lamp (1), and the secondary reflector (3) is constituted by a tray-like element with a curved surface. The primary reflector (2) further includes a tile (9), which extends longitudinally between each pair of cup-like elements (4).

7 Claims, 3 Drawing Sheets

CONTROLLED-LUMINANCE LIGHTING DEVICE

FIELD OF THE INVENTION

The present invention relates to lighting devices, for example ones used in residential, commercial and industrial environments, of the kind comprising at least one fluorescent light source of a linear type, which extends longitudinally between a primary reflector and a secondary reflector.

SUMMARY OF THE INVENTION

The purpose of the present invention is to provide a lighting device of the type defined above, which is designed to enable a low luminance, at the same time ensuring a high efficiency.

According to the invention, the above purpose is achieved thanks to the fact that, in a lighting device of the type defined at the beginning of this description:

- the primary reflector is formed by a plurality of cup-like elements set alongside one another, having a generally parabolic shape, through which there extends said light source; and
- the secondary reflector is constituted by a tray-like element with a curved surface, the bottom wall of which has a cusp in a position longitudinally corresponding to said light source.

The cup-like elements set alongside one another, in practice, envelop the light source completely for some stretches and perform the function of angular control of the light beam emitted by the light source. This enables an effective angular control of the light beam with a structure of small dimensions.

The portions of the light source that extend between each pair of contiguous cup-like elements would be directly exposed outwards, in the sense that the relative luminous flux would not be gathered by the cup-like elements. In order to recover also this luminous flux, the primary reflector further conveniently includes a tile, which extends between each pair of contiguous cup-like elements and is formed by a pair of opposed curved flanges.

In a variant of the device according to the invention, the tray-like element constituting the secondary reflector is, in turn, formed by a plurality of tray-like elements set alongside one another.

BRIEF DESCRIPTION OF THE DRAWINGS

The present invention will now be described in detail with reference to the attached drawings, which are provided purely by way of non-limiting example, and in which.

DETAILED DESCRIPTION OF THE INVENTION

With initial reference to FIGS. 1 to 4, the lighting device according to the invention comprises at least one fluorescent lamp 1 of a linear type, which extends longitudinally between a primary reflector 2 and a secondary reflector 3.

Figure 4:
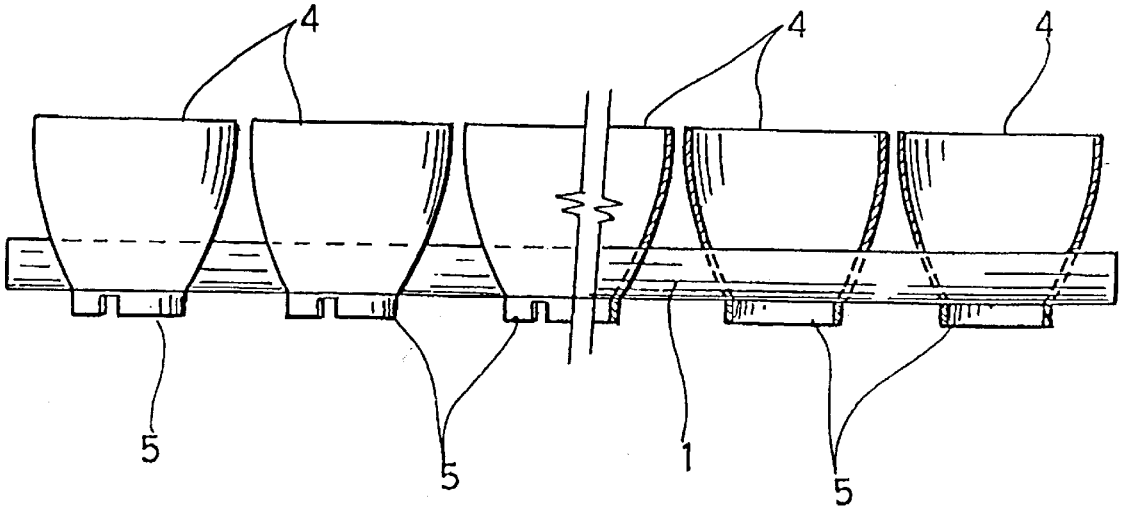
FIG. 4 is a partially sectioned side elevation of a part of the device illustrated in FIGS. 1 to 3.

The primary reflector 2 is formed by a plurality of cup-like elements 4 set alongside one another, having a generally parabolic surface, through which there extends said fluorescent lamp 1 in the way represented in greater detail in FIG. 4.

Each cup-like element 4 has a bottom 4*a* with a respective cusp 4*b* in a position corresponding to the lamp 1, and between the lamp 1 and the secondary reflector 3 a respective tubular appendage 5 engaged within a longitudinal opening 6 formed in the bottom wall 7 of the secondary reflector 3. The said opening 6 may be interrupted in the areas not occupied by the appendages 5 of the cup-like elements 4, and in this case the bottom wall 7 of the secondary reflector 3 will present, in positions corresponding to said areas, respective cusps 8 arranged in positions longitudinally corresponding to the lamp 1.

The primary reflector 2 is completed by a perforated tile 9, which extends between each pair of contiguous cup-like elements 4 and is formed by two opposed curved flanges (10, 11).

The secondary reflector 3 is constituted by an elongated tray-like element with a curved surface, the bottom wall 7 of which has the conformation described above.

Figure 5:
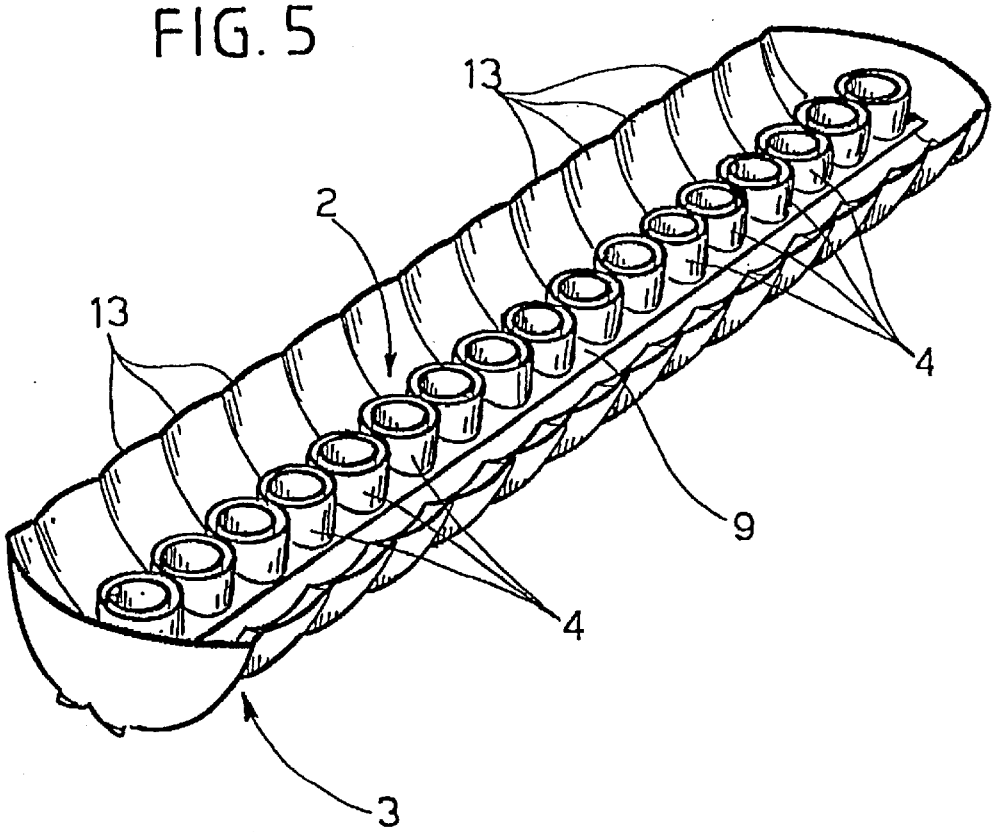
FIG. 5 illustrates a variant of the device of FIG. 1.
Figure 6:
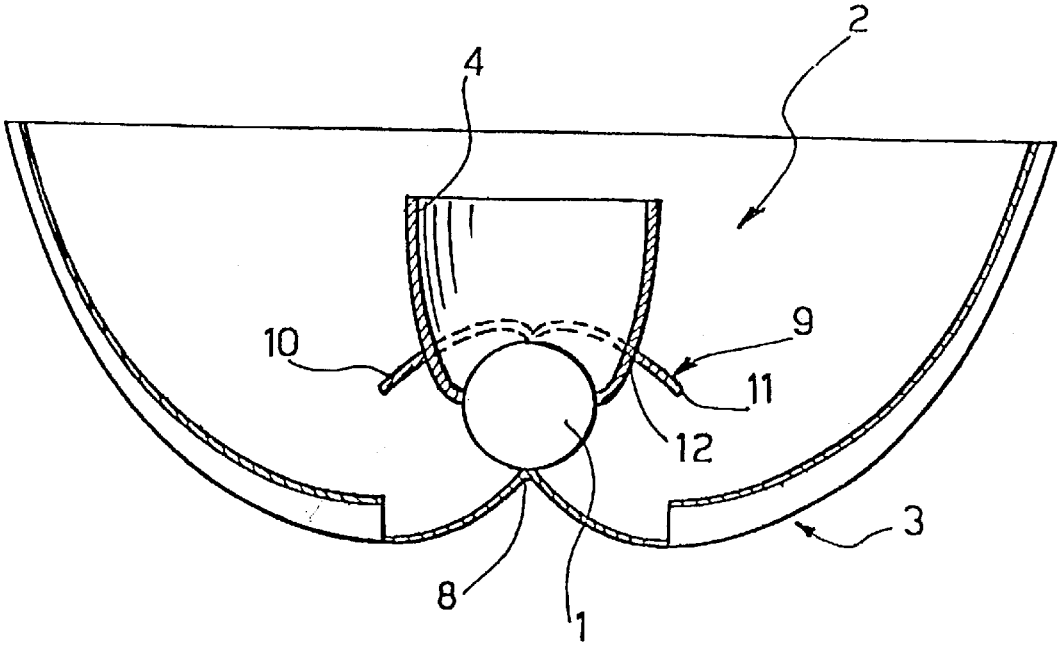
FIG. 6 is a cross-sectional view at an enlarged scale of the device of FIG. 5.

The variant of the device represented in FIGS. 5 and 6 is generally similar to the one described previously, and only the differences will be described in detail in what follows, using the same reference numbers for identical or similar parts.

In the aforesaid variant, the cup-like elements 4 are tubular and devoid of appendages 5, and are engaged in corresponding holes 12 of the tile 9. In this case, the longitudinal opening 6 of the secondary reflector 3 can be eliminated, and the said secondary reflector 3 is conveniently formed by a plurality of tray-like elements 13 set alongside one another and normally made of a single piece.

Figure 1:
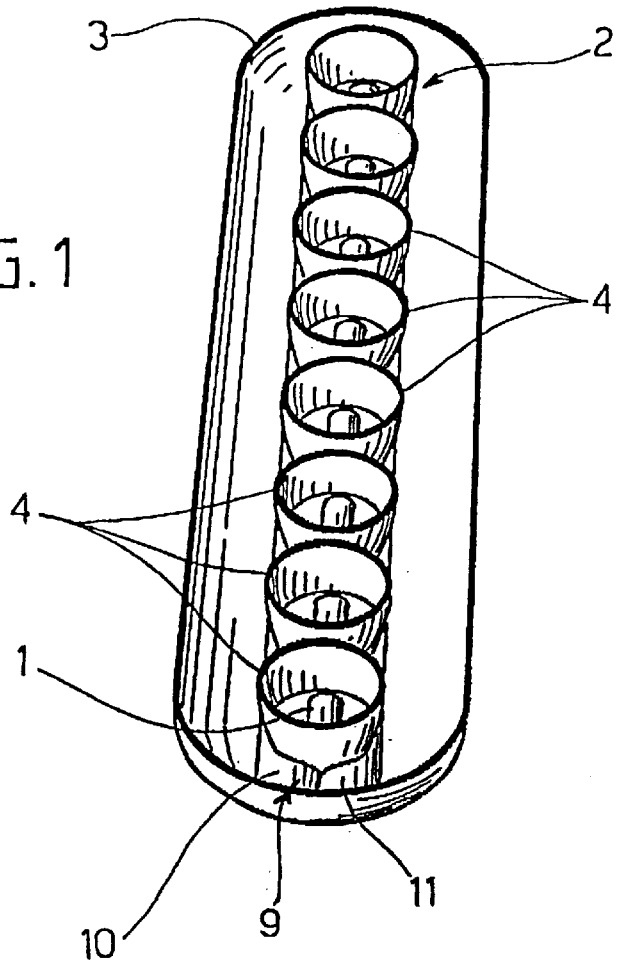
FIG. 1 is a schematic perspective plan view from underneath of a controlled-luminance lighting device according to the invention.
Figure 2:
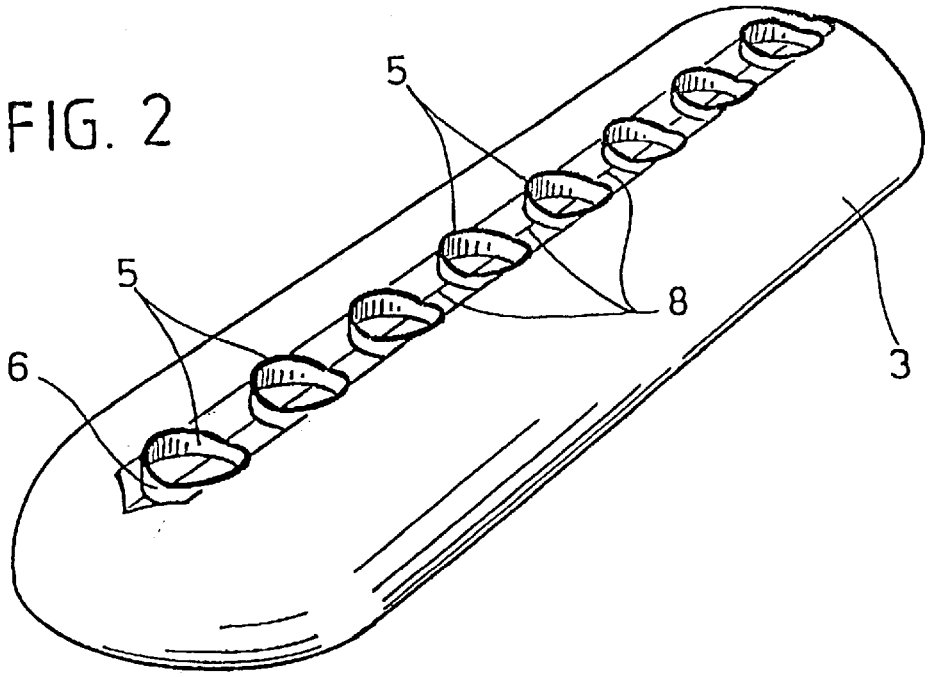
FIG. 2 is a perspective top-plan view of the device.
Figure 3:
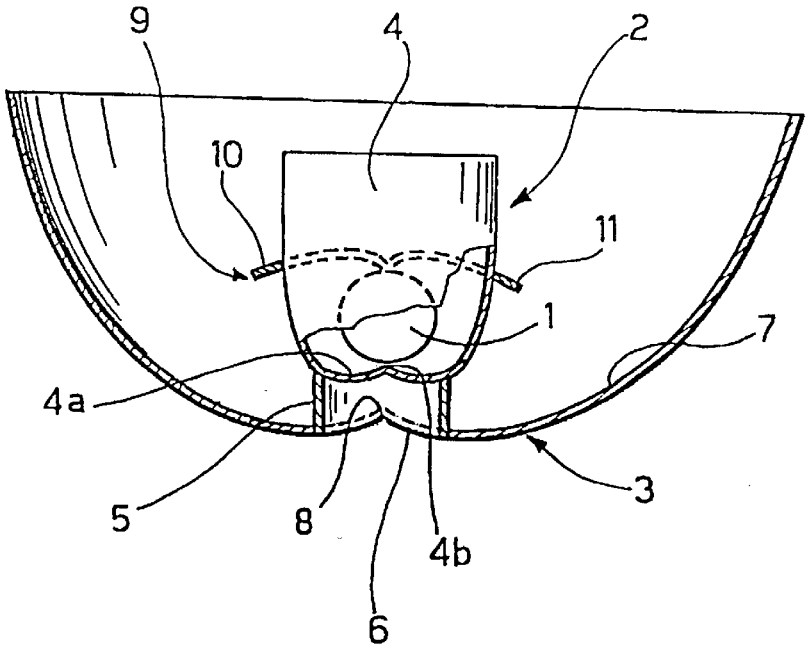
FIG. 3 is a cross-sectional view at an enlarged scale of the device.

The device according to the invention can be set into a wall or ceiling (obviously, in the position corresponding to the one represented in FIG. 2) or it can be set suspended. In this latter case, the secondary reflector 3 may be formed with openings (not illustrated).

Of course, the details of construction and the embodiments may vary widely with respect to what is described and illustrated herein purely by way of example, without thereby departing from the scope of the present invention, as defined in the ensuing claims.

What is claimed is:

1. A controlled-luminance lighting device, comprising at least one fluorescent light source of a linear type (1), which extends longitudinally between a primary reflector (2) and a secondary reflector (3), wherein:

- the primary reflector (2) is formed by a plurality of cup-like elements (4) set alongside one another having a generally parabolic shape, through which there extends said light source (1); and
- the secondary reflector (3) is constituted by a tray-like element with a curved surface, the bottom wall (7) of which has cusps (8) in a position longitudinally corresponding to said light source (1).

2. The lighting device according to claim 1, wherein said primary reflector (2) further includes a tile (9), which extends between each pair of contiguous cup-like elements (4) and is formed by two opposed curved flanges (10, 11).

3. The lighting device according to claim 1, wherein said secondary reflector (3) is formed with a longitudinal opening (6).

4. The lighting device according to claim 3, wherein each of said cup-like elements (4) has a tubular appendage (5) set within said longitudinal opening (6) of the secondary reflector (3).

5. The lighting device according to claim 4, wherein each of said cup-like elements (4) has a bottom wall **(4*a*) formed with a cusp (4*b*) in a position corresponding to said light source (1)**.

6. The lighting device according to claim 1, wherein said tray-like element, which defines said secondary reflector (3), is formed by a plurality of tray-like elements (13) set alongside one another.

7. The lighting device according to claim 1 designed to be set in or suspended.

* * * * *